US005165631A

United States Patent [19]

Norsworthy

[11] Patent Number: 5,165,631

[45] Date of Patent: Nov. 24, 1992

[54] MUSIC STAND

[75] Inventor: John A. Norsworthy, Gloucester, Canada

[73] Assignee: Unique Quality Products, Inc., High River, Canada

[21] Appl. No.: 618,239

[22] Filed: Nov. 21, 1990

[30] Foreign Application Priority Data

Oct. 24, 1990 [CA] Canada ..... 2028407

[51] Int. Cl.[5] ..... A47B 97/00

[52] U.S. Cl. ..... 248/121; 248/176

[58] Field of Search ..... 248/121, 124, 125, 146, 248/176, 346, 163.2, 440.1; 211/60.1, 13; 84/327, 329

[56] References Cited

U.S. PATENT DOCUMENTS

| | | | |
|---|---|---|---|
| D. 261,703 | 11/1981 | Plummer | 248/121 X |
| 1,734,577 | 11/1929 | Henry | 248/121 |
| 2,153,821 | 4/1939 | Walberg | 248/121 |
| 2,522,345 | 9/1950 | Cashiopp | 248/121 |
| 2,901,860 | 9/1959 | Crawford | 211/13 |
| 3,102,638 | 9/1963 | Saunders | 248/121 X |
| 3,665,490 | 5/1972 | Oskar | 84/329 X |
| 3,737,137 | 6/1973 | Sheehan | 248/121 X |
| 3,958,786 | 5/1976 | Mann | 248/176 |
| 4,099,441 | 7/1978 | Landon | 248/176 X |
| 4,205,818 | 6/1980 | Lawler | 211/13 X |
| 4,215,838 | 8/1980 | Gullota | 248/176 X |
| 4,546,688 | 10/1985 | Cuccib | 84/327 |
| 4,760,984 | 8/1988 | Hennessey | 248/121 |
| 4,887,784 | 12/1989 | Kayali | 248/311.2 |

FOREIGN PATENT DOCUMENTS

| | | | |
|---|---|---|---|
| 3452 | 10/1834 | France | 248/121 |
| 694378 | 6/1930 | France | 248/121 |

*Primary Examiner*—Karen J. Chotkowski

*Attorney, Agent, or Firm*—Mason, Fenwick & Lawrence

[57] ABSTRACT

There is provided a new and useful music stand comprising a base having at least three outwardly extending legs and at least one outwardly extending lower instrument support yoke; an upright section supported by the base; and a top section carried on the upright and including at least one integral upper instrument support yoke.

16 Claims, 2 Drawing Sheets

MUSIC STAND

FIELD OF THE INVENTION

This application relates to music stands.

BACKGROUND OF THE INVENTION

There has been a need for an improved music stand and, more generally for an improved stand for supporting various of the paraphernalia which is from time to time associated with music playing. It is evident that a musician or a more youthful practising musician will improve playing where distraction are minimized. Thus, for example, having sheet music, microphones and other paraphernalia and accessories readily available and conveniently positioned will contribute to increased concentration. It has in the past frequently been necessary to utilize a variety of stands for holding music, microphones, picks and the like, and for supporting instruments not in use. This has often resulted in a rather cluttered set up. Adjustments become difficult because of the clutter. As well, it becomes more difficult to reach extra sheet music and other needed items.

A music stand has now been provided which integrates a number of requirements of a musician to provide a more organized and substantially less cluttered environment which thereby lessens distractions and contributes to the ability to concentrate on music.

PRIOR ART

Applicant is unaware of any prior documents which describe a music stand which is in any way relevant to the present invention.

SUMMARY OF THE INVENTION

The invention provides a music stand comprising a base having at least three outwardly extending legs and at least one outwardly extending lower instrument support yoke; an upright section supported by the base; and a top section carried on the upright and including at least one integral upper instrument support yoke.

BRIEF DESCRIPTION OF THE DRAWINGS

In drawings which illustrates embodiments of the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figures 1, 2, 3:
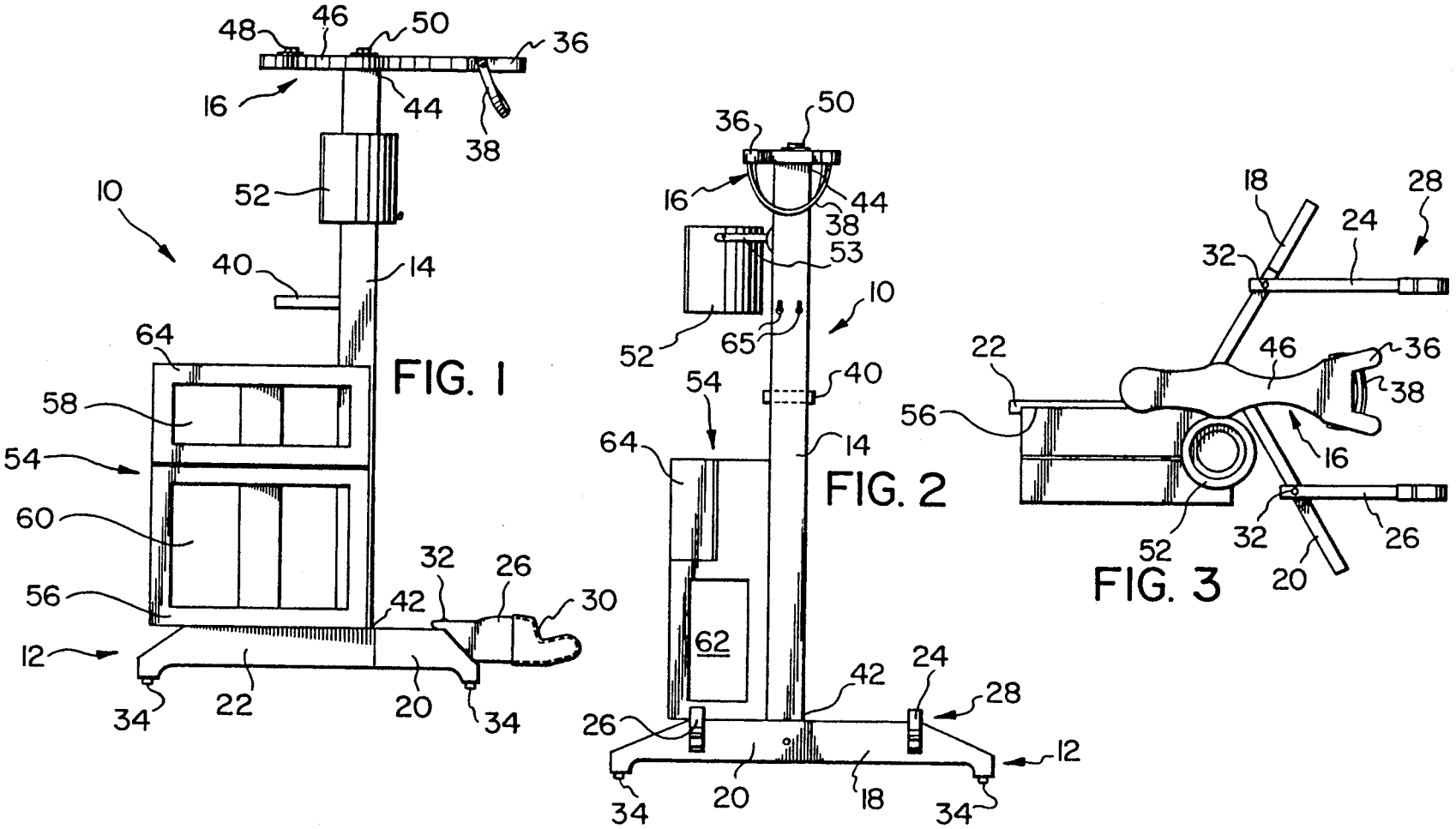
FIG. 1 is a side elevation of a music stand according to the invention.
FIG. 2 is an end elevation of a music stand according to the invention.
FIG. 3 is a top plan view of a music stand according to the invention.

In the embodiment illustrated in FIGS. 1 to 3 a music stand 10 comprises a base 12, upright section 14 and top section 16. The base 12 comprises a series, preferably 3, outwardly extending legs 18, 20 and 22.

Legs 18 and 20 carry the parts 24 and 26 of a lower instrument support yoke 28. As is most clearly shown in FIG. 1, parts 24 and 26 are profiled as at 30 to receive the end of an instrument such as a guitar. Parts 24 and 26 are secured respectively to legs 18 and 20 by screws 32.

The legs 18, 20 and 22 preferably sit on feet 34.

The upright section 14 is supported on and secured to base 12.

The top section 16 is secured to upright section 14. Top section 16 includes an integral upper instrument support yoke 36 which is oriented in proper alignment with yoke 28 to receive the top of an instrument such as a guitar which is resting in yoke 28. A strap 38 is provided for securing the instrument in the yoke, if desired.

Both the upright section 14 and top section 16 are preferably adapted to receive clamps on the bottom of sheet music or microphone support arms. Thus, upright section 14 preferably includes means 40 intermediate the ends 42 and 44 for this purpose. Means 40 is preferably a shelf which extends outwardly of at least one side of upright section 14.

At least a part 46 of top section 16 forms a flat shelf like area also adapted to receive clamps.

In the preferred embodiment the top section 16 includes threaded projections 48 and 50 for receiving threaded support posts for sheet music and microphone support arms.

In the preferred embodiment the upright section 14 has secured thereto a means such as cylinder 52 which is hollow and open at the top for receiving and supporting a beverage container.

The music stand 10 preferably includes the music and bookshelf 54. The longer side 56 is preferably located along the outwardly extending leg 22. The bookshelf 54 is thus supported by the leg 22 and is also secured to the upright section 14.

In this configuration the bookshelf 54 will add to the stability of stand 10 by acting as a counterbalance for an instrument secured in the yokes 28 and 36.

Bookshelf 54 is preferably constructed with open sides as at 58, 60 and 62 to provide easy location of music and music books. The bookshelf 54 is also preferably provided with a hinged lid 64 which will enable the stand to be readily moved without the necessity for removing the material from the bookshelf 54.

A hook or a pair of hooks 65 may be provided for purposes of hanging accessories such as a tuner case (not illustrated) by the case strap.

Figure 6:
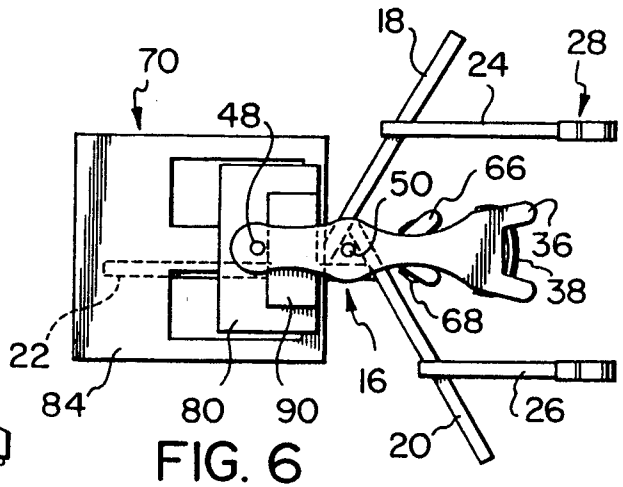
FIG. 6 is a top plan view of the embodiment of FIG. 4.
Figure 5:
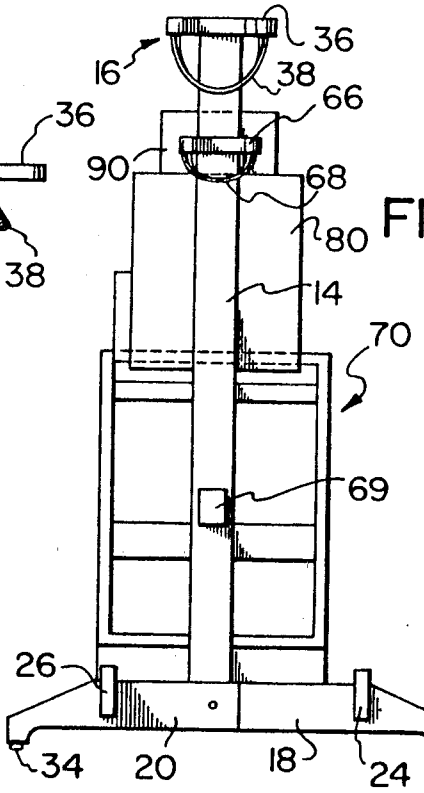
FIG. 5 is an end elevation of the embodiment of FIG. 4.
Figure 4:
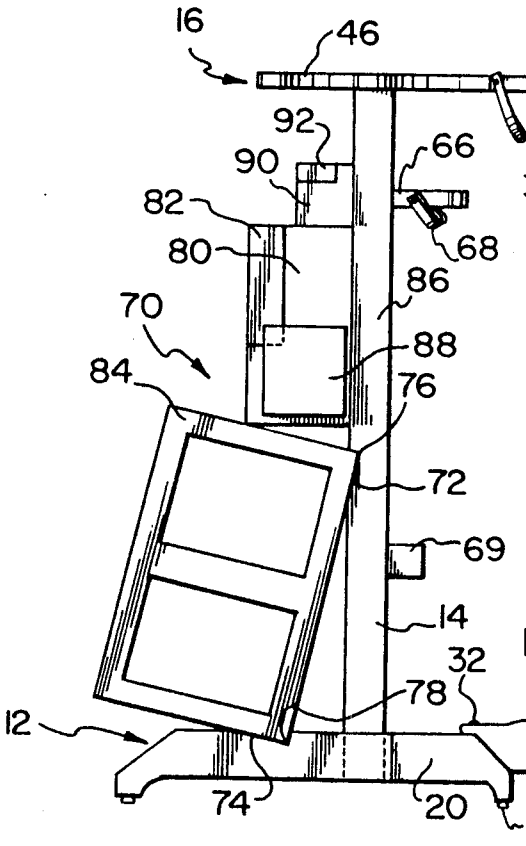
FIG. 4 is a side elevation of a second embodiment of the music stand to the invention.

Additional preferred features of the invention are illustrated in the embodiment of FIGS. 4 to 6. In that embodiment the upright section 14 is provided with a second upper yoke 66 from which a smaller instrument such as a violin may be hung. A strap 68 is provided for extra security.

A lower pad 69 is provided to abut with a protective surface against a lower part of an instrument hung in yoke 66.

All of the yokes and pads 68 are preferably well padded for protection of instruments placed in them.

The FIG. 4 to 6 embodiment also illustrates a second format of bookshelf and storage container. Thus the bookshelf 70 is oriented transverse to the leg 22. Notches 72 and 74 are provided in upright section 1 and leg 22 to receive the edges 76 and 78 respective of bookshelf 70. In this embodiment the bookshelf 70 has an open front for easy access to books and music. As is evident in FIG. 4, the bookshelf 70 is oriented at an angle to the vertical to more securely retain materials placed in it.

A second storage container 80, closed and with a hinged lid 82 is supported on the top 84 of bookshelf 70 and is secured alongside 86 to upright section 14.

A beverage container holder 88 is secured to one side of container 80.

Container 80 is particularly well adapted for containing microphone cord and the like.

A further smaller closed container 90 having hinged lid 92 is positioned on the top of container 80 and secured to the upright section 14. This container is particularly well adapted for storage of small accessories such as picks, connectors and the like.

Thus it is apparent that there has been provided in accordance with the invention a music stand that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A music stand comprising:

a base having at least three outwardly extending legs and at least one outwardly extending lower instrument support yoke;

an upright section supported by said base;

a top section carried on said upright and including an elongated substantially horizontal flat shelf-like section having at least one integral upper instrument support yoke; and a bookshelf extending along and secured to one said outwardly extending leg and also secured at one end of said bookshelf to said upright section, said bookshelf being located on an opposite side of said upright section from said at least one lower instrument support yoke.

2. A music stand comprising:

a base having at least three outwardly extending legs and at least one outwardly extending lower instrument support yoke;

an upright section supported by said base;

a top section carried on said upright and including an elongated substantially horizontal flat shelf-like section having at least one integral upper instrument support yoke; and a bookshelf extending along and secured to one said outwardly extending leg and to said upright section, said bookshelf located on an opposite side of said upright section from said at least one lower instrument support yoke;

and wherein said lower instrument support yoke includes first and second parts, one said part carried by each of two legs other than said leg carrying said bookshelf.

3. The music stand of claim 2 including means secured intermediate the ends of said upright section for receiving a clamp of a sheet music or microphone support arm.

4. The music stand of claim 3, wherein said means comprises a small horizontal shelf extending outwardly from at least one side of said upright.

5. The music stand of claim 2 including means secured toward an upper end of said upright section for supporting a beverage holder.

6. The music stand of claim 5, wherein said means comprises a hollow cylindrical container closed at a bottom end thereof.

7. The music stand of claim 2, wherein said upright section includes secured toward an upper end thereof a second upper yoke for hanging a musical instrument.

8. The music stand of claim 7, wherein said upright section includes secured toward a lower end thereof and aligned with said second upper yoke a padded member for abutting a lower part of an instrument hanging in said second upper yoke.

9. The music stand of claim a strap associated with said second upper yoke for securing an instrument in said yoke.

10. The music stand of claim 2 including a strap associated with said upper instrument support yoke for securing an instrument in said yoke.

11. The music stand of claim 2, wherein said bookshelf is transverse to said one outwardly extending leg.

12. The music stand of claim 11, wherein said lower instrument support yoke includes first and second parts, one said part carried by each of two legs other than said leg carrying said bookshelf.

13. The music stand of claim 2, wherein said top section includes at least one threaded projection for receiving a microphone support arm.

14. The music stand of claim 2, wherein said stand is constructed of hardwood.

15. The music stand of claim 2 wherein said bookshelf is transverse to said one outwardly extending leg.

16. A music stand comprising:

a base having at least three outwardly extending legs and at least one outwardly extending lower instrument support yoke;

an upright section supported by said base;

a top section carried on said upright and including an elongated substantially horizontal flat shelf-like section having at least one integral upper instrument support yoke;

a bookshelf extending along and secured to one said outwardly extending leg, said bookshelf transverse to said leg and located on an opposite side of said upright section from said at least one lower instrument support yoke; and a closeable storage container secured to said upright section and supported by a top member of said bookshelf.

* * * * *